US008467708B2

(12) United States Patent
Sato

(10) Patent No.: US 8,467,708 B2
(45) Date of Patent: Jun. 18, 2013

(54) DEVELOPER UNIT FOR AN IMAGE FORMING APPARATUS WITH A CIRCULATIVE STRUCTURE FOR DEVELOPER AGENT

(75) Inventor: Shougo Sato, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 340 days.

(21) Appl. No.: 12/910,657

(22) Filed: Oct. 22, 2010

(65) Prior Publication Data

US 2011/0103845 A1 May 5, 2011

(30) Foreign Application Priority Data

Oct. 29, 2009 (JP) ..... 2009-248828

(51) Int. Cl.
*G03G 15/08* (2006.01)

(52) U.S. Cl.
USPC ..... 399/263

(58) Field of Classification Search
USPC ..... 399/258, 260, 262, 263
See application file for complete search history.

(56) References Cited

U.S. PATENT DOCUMENTS 7,801,468 B2 * 9/2010 Shimomura ..... 399/260
2009/0142116 A1 6/2009 Sato et al.

FOREIGN PATENT DOCUMENTS

JP 2009-139490 A 6/2009

* cited by examiner

*Primary Examiner* — William J Royer
(74) *Attorney, Agent, or Firm* — Baker Botts L.L.P.

(57) ABSTRACT

A developer unit for an image forming apparatus is provided. The developer unit includes a developer device with a developer agent carrier, a developer agent container arranged in an upper position with respect to the developer device. The developer agent container is formed to have a fitting wall, which is curved inward at a position to be adjacent to the developer device. The developer agent container includes an agitator, which is rotated to sweep an inner surface of the fitting wall and stir developer agent in the developer agent container. The fitting wall is formed to have a first feeding hole and a first collecting hole. A first angle between a direction, in which the first collecting hole is oriented, and a vertical direction is larger than a second angle between a direction, in which the first feeding hole is oriented, and the vertical direction.

9 Claims, 10 Drawing Sheets

DEVELOPER UNIT FOR AN IMAGE FORMING APPARATUS WITH A CIRCULATIVE STRUCTURE FOR DEVELOPER AGENT

CROSS REFERENCE TO RELATED APPLICATION

This application claims priority from Japanese Patent Application No. 2009-248828, filed on Oct. 29, 2009, the entire subject matter of which is incorporated herein by reference.

BACKGROUND

1. Technical Field

An aspect of the present invention relates to a developer unit for an image forming apparatus, in which developer agent is smoothly circulated.

2. Related Art

An image forming apparatus for forming an image on a recording medium with a developer unit has been known. The developer unit is often provided with a developer device with a developer roller to carry a developer agent and a developer agent container to contain and supply the developer agent to the developer device. In order to supply the developer agent in homogenized condition so that consistent image-forming quality is maintained, the developer unit may be specifically designed to have the developer agent to be circulated between the developer device and the developer agent container. In such a developer unit, the developer agent container may be arranged in a higher position with respect to the developer device, and the developer agent stored in the developer agent container is supplied to the developer device so that the developer agent may be supplied from the developer agent container to the developer device smoothly by use of gravity. However, in the developer unit, conveying the developer agent reversely from the developer device to the developer agent container against the gravity has been difficult.

SUMMARY

Such a difficulty can be overcome by augers, which carry the developer agent upwardly from the developer device to the developer agent container against the gravity. With the augers, the developer agent may be preferably circulated between the developer device and the developer agent container. However, providing the augers in the developer unit requires a more complicated structure for the developer unit.

In view of the above deficiencies, the present invention is advantageous in that a developer unit, in which a developer agent is circulated in a less complicated configuration, is provided.

According to an aspect of the present invention, a developer unit for an image forming apparatus to form an image on a recording sheet is provided. The developer unit includes a developer device having a developer agent carrier, which carries a developer agent on a surface thereof, a developer agent container, which contains the developer agent and is arranged in an upper position with respect to the developer device in the developer unit. The developer agent container is formed to have a fitting wall, which is curved inward at a position to be adjacent to the developer device. The developer agent container includes an agitator, which is rotated to sweep an inner surface of the fitting wall and stir the developer agent in the developer agent container. The fitting wall is formed to have a first feeding hole, through which the developer agent in the developer agent container is supplied to the developer device, and a first collecting hole, through which the developer agent in the developer device is retrieved. A first angle between a direction, in which the first collecting hole is oriented, and a vertical direction is larger than a second angle between a direction, in which the first feeding hole is oriented, and the vertical direction.

BRIEF DESCRIPTION OF THE ACCOMPANYING DRAWINGS

DETAILED DESCRIPTION

Hereinafter, an embodiment of the present invention will be described with reference to the accompanying drawings. A color multifunction peripheral device (hereinafter, MFP) 1 represents an image processing device having a developer unit 61 according to the present invention.

Overall Configuration of the MFP

Figure 1:
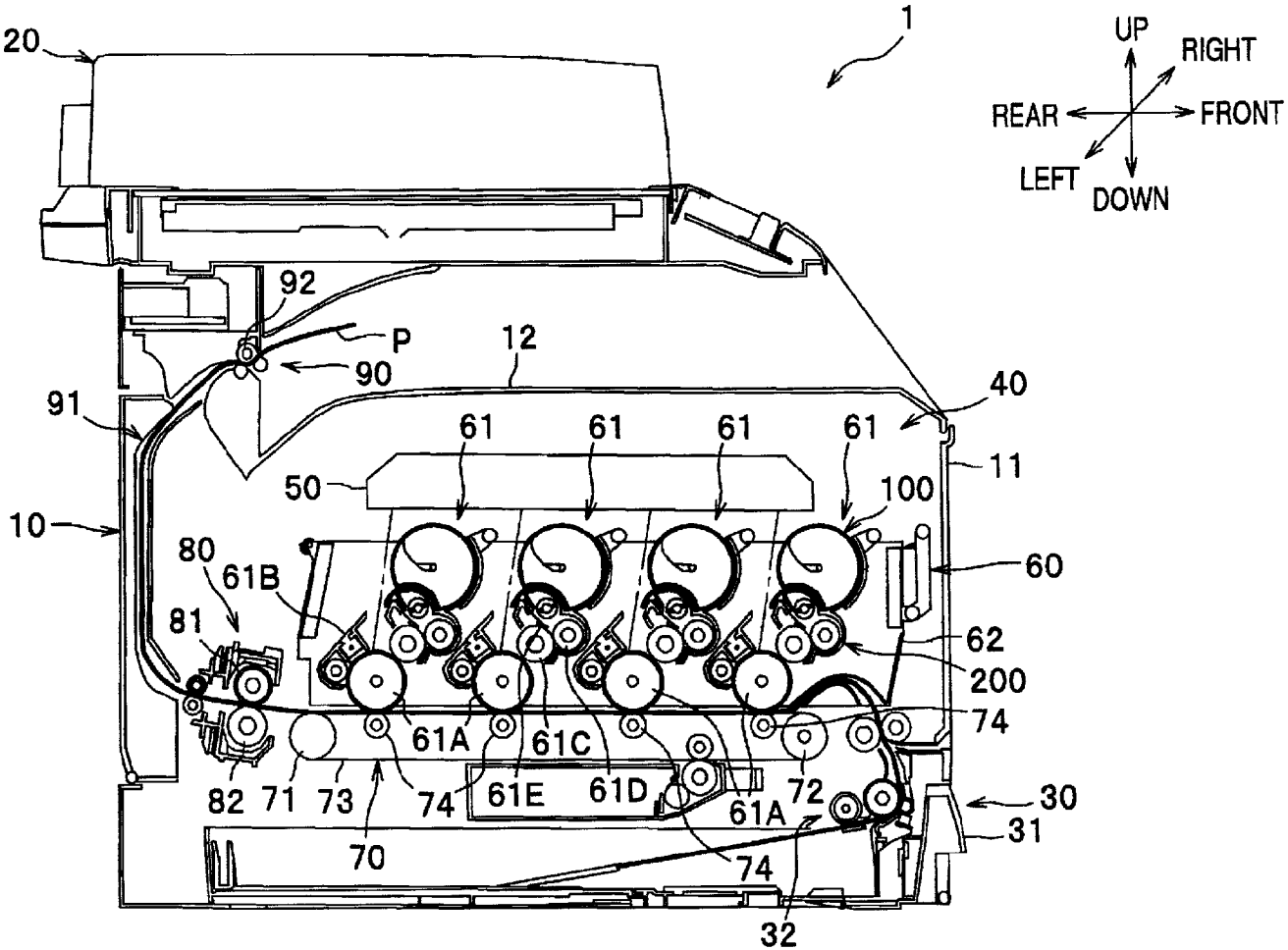
FIG. 1 is a schematic cross-sectional view of a multifunction peripheral device (MFP) having developer units according to an embodiment of the present invention.

As shown in FIG. 1, the MFP 1 is equipped with a chassis 10 and a flatbed scanner 20. In the chassis 10, the MFP 1 is provided with a sheet-feed unit 30, which feeds recording sheet P in a feeding path, an image forming unit 40, which forms an image on the sheet P being fed, and a discharge unit 90, which ejects the sheet P with the image formed thereon.

Figure 2:
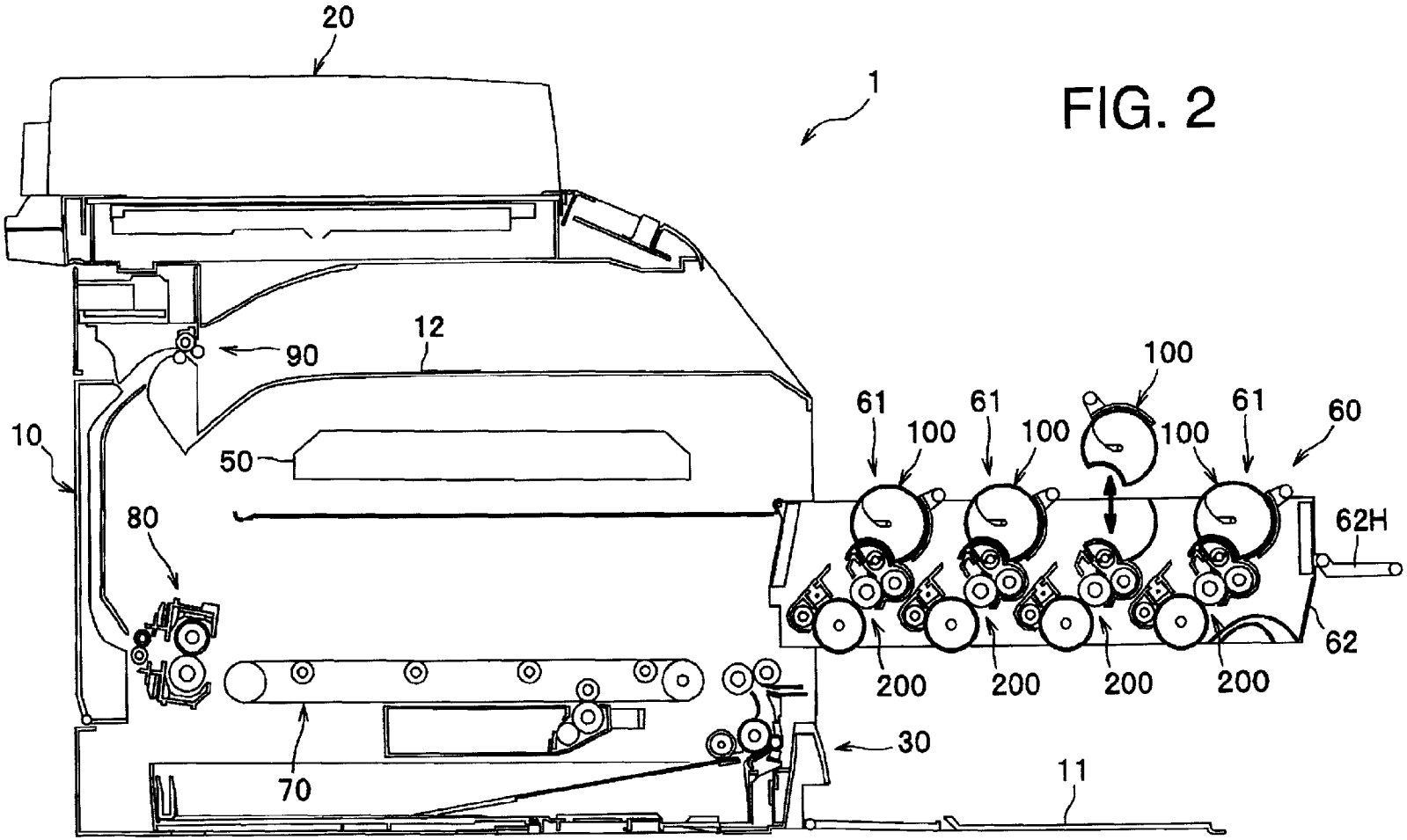
FIG. 2 is a schematic view of the MFP and the developer units according to the embodiment of the present invention with a holder case removed out of a chassis.

In the present embodiment, directions concerning the MFP 1 will be referred to in accordance with orientation of the MFP 1 shown in FIG. 1. That is, a viewer's right-hand side appearing in FIG. 1 is referred to as a front side of the MFP, and a left-hand side, which is an opposite side from the front side, is referred to as a rear side. Further, a viewer's nearer side is referred to as a left side, and a further side is referred to as a right side. Furthermore, a vertical (up-down) direction of the MFP 1 corresponds to an up-down direction appearing in FIG. 1. Directions of the drawings in FIG. 2 are similarly based on the orientation of the MFP 1 as defined above and correspond to those with respect to the MFP 1 shown in FIG. 1. In FIGS. 3-6, directions of the drawings are as indicated by arrows.

The flat bed scanner 20 is a known document reader, which is arranged on top of the chassis 10. The flatbed scanner 20 irradiates light onto a source document to read an image formed thereon and creates image data representing the read image. Thus, the image on the source document can be copied.

The sheet-feed unit 30 is arranged in a lower section of the chassis 10. The sheet-feed unit 30 includes a sheet-feed tray 31, in which the sheets P are stored, and a sheet-feeder 32, which conveys the sheets P one-by-one from the sheet-feed tray 31 to the image forming unit 40.

The image forming unit 40 includes an exposure section 50, a processing section 60, a transfer section 70, and a fixing section 80.

The exposure section 50 is arranged in an upper section in the chassis 10 and includes a laser-beam source, a polygon mirror, a lens, and a reflection mirror, which are not shown. A laser beam emitted from the laser-beam source is reflected on the polygon mirror and the reflection mirror and transmits through the lens to be cast to scan on surfaces of photosensitive drums 61A.

The processing section 60 is arranged between the sheet-feed unit 30 and the exposure section 50 and includes four developer units 61, which are aligned in line along a front-rear direction, and a holder case 62 to hold the developer units 61.

Each of the developer units 61 includes a toner box 100 and a developer device 200. The toner box 100 contains toner being a developer agent therein. Each toner in the toner box 100 is in a different color, and in the present embodiment, a colored image is formed in the four colored toners. The developer device 200 includes the photosensitive drum 61A, a charger 61B, a developer roller 61C to carry the toner, a supplier roller 61D, and a spreader blade 61E (see FIG. 3). The developer unit 61 including the toner box 100 and the developer device 200 will be described later in detail.

The holder case 62 can be installed in the chassis 10 through an opening, which can be covered with a front cover 11. The holder case 62 has a handle 62H, and when the front cover 11 is open (see FIG. 2), the holder case 62 can be drawn out of the chassis 10 by the handle 62H. When the holder case 62 is outside the chassis 10, the toner boxes 100 can be removed from the chassis 10 and replaced with new toner boxes 100. The developer devices 200 may be either detachable from the holder case 62 or fixed to the holder case 62.

The transfer section 70 is arranged between the sheet-feed unit 30 and the processing section 60. The transfer section 70 includes a driving roller 71, a driven roller 72, and an endless conveyer belt 73, which is extended to roll around the driving roller 71 and the driven roller 72, and four transfer rollers 74. The conveyer belt 73 is arranged to have its upper and outer surface to be in contact with the photosensitive drums 61A. The transfer rollers 74 are arranged in positions to be in contact with an upper-inner surface of the conveyer belt 73 to nip the conveyer belt 73 with the photosensitive drums 61A.

The fixing section 80 is arranged in a position closer to the rear of the MFP 1 and includes a heat roller 81 and a pressure roller 82. The pressure roller 82 is arranged in a position opposite from the heat roller 81 and presses the sheet P against the heat roller 81.

In the image forming unit 40, the charger 61B charges the surface of the photosensitive drum 61A evenly, and the surface of the photosensitive drum 61A is exposed to the laser beam emitted based on the image data from the exposure section 50 in order to form an electrostatic latent image thereon. Meanwhile, the toner in the toner box 100 is supplied to the developer roller 61C via the supplier roller 61D and spread evenly in a layer of a predetermined thickness by the spreader blade 61E to be carried by the developer roller 61C.

When the toner on the developer roller 61C comes in contact with the photosensitive drum 61A, the toner is supplied to the surface of regions corresponding to the electrostatic latent image formed on the photosensitive drum 61A. Accordingly, the electrostatic latent image is developed to be a toner image on the photosensitive drum 61A. As the photosensitive drum 61A is rotated further, and when the sheet P conveyed on the conveyer belt 73 comes to a position opposite from the photosensitive drum 61A and the transfer roller 74, the toner image on the photosensitive drum 61A is transferred to the sheet P. Thus, an image in a color of the toner is formed on the sheet P. As the sheet P is continuously conveyed in the image forming unit 40, images in the different colors corresponding to the other toners are sequentially formed on the sheet P so that the colored image is completed. The sheet P is further conveyed in the fixing section 80 between the heat roller 81 and the pressure roller 82, and the colored image is thermally fixed on the sheet P.

The discharge unit 90 includes a discharge guide 91, which is formed to direct the sheet P from the fixing section 80 toward the upward-front of the MFP 1, and a discharge roller 92 to eject the sheet P out of the discharge unit 90. The sheet P with the thermally-fixed toner image is carried along the discharge guide 91 and directed to a discharge tray 12, which is formed in an upper section of the chassis 10.

Configuration of the Developer Unit

The developer unit 61 including the toner box 100 and the developer device 200 will be described in detail hereinbelow.

Firstly, the toner box 100 will be described. The toner box 100 is installed in the developer unit 61 in an upper and adjoining position with respect to the developer device 200 (see also FIG. 2) to be detachably attached to the developer device 200. The toner box 100 is formed to have a shape of a partially-dented cylinder with left and right side walls 101. In particular, a circumferential surface of the cylinder is formed to have a fitting wall 110 in a position to be adjacent to the developer device 200 when the toner box 100 is attached to the developer device 200. The fitting wall 110 is curved inward in an arc to fit with an outer peripheral surface of the adjoining developer device 200. The fitting wall 110 is dented, in a cross-sectional view (see FIG. 3), to center around a reference line BL, which extends in parallel with a rotation axis 141 of an agitator 140 in the toner box 100. Description of the agitator 140 will be given later in detail.

The fitting wall 110 is formed to have a first feeding hole 111 and two first collecting holes 112. The first feeding hole 111 is an opening, through which the toner stored in the toner box 100 is supplied to the developer device 200. A flow of supplying the toner through the first feeding hole 111 is indicated by a thick solid arrow in FIG. 3. The first collecting holes 112 are openings, through which the toner in the developer device 200 is retrieved to be stored in the toner box 100. A flow of collecting the toner through the first collecting holes 112 is indicated by a thick broken arrow in FIG. 3.

Figure 4:
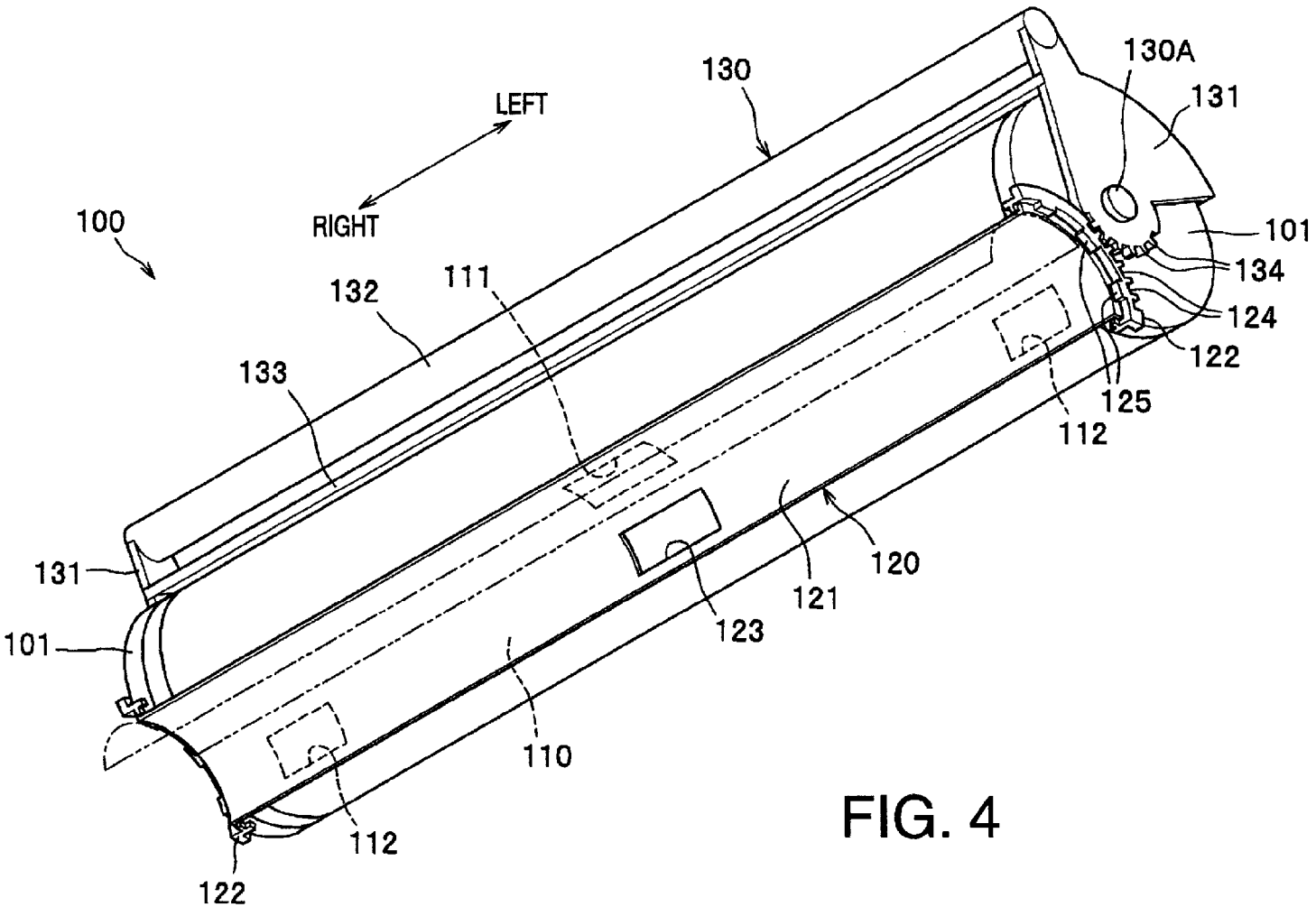
FIG. 4 is a perspective view of a toner box of the developer unit according to the embodiment of the present invention.
Figure 5A:
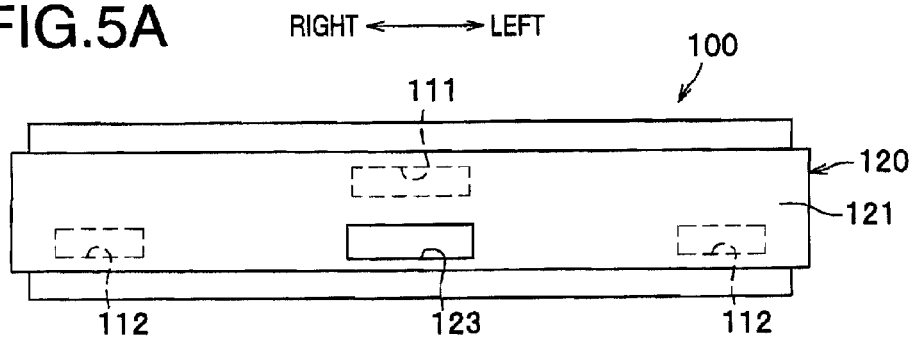
FIG. 5A is a schematic view of the toner box of the developer unit according to the embodiment of the present invention with a first shutter in a closing position.
Figure 5B:
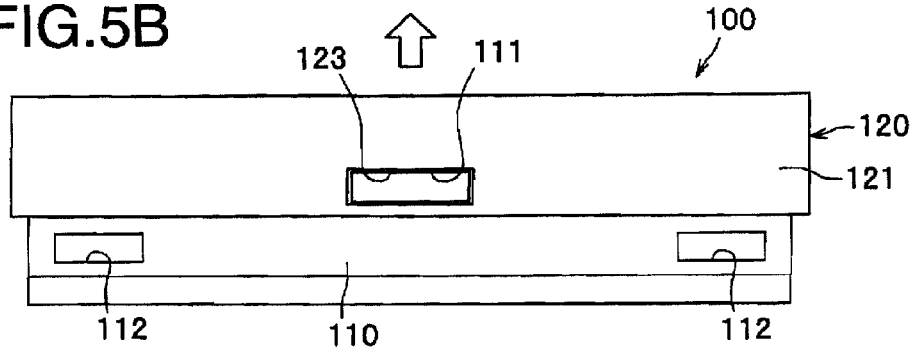
FIG. 5B is a schematic view of the toner box of the developer unit according to the embodiment of the present invention with the first shutter in an opening position.

The first feeding hole 111 and the first collecting holes 112 are formed in horizontally (in the right-left direction) displaced positions. The right-left direction in the present embodiment corresponds to the direction of the rotation axis 141 of the agitator 140. As shown in FIGS. 4, 5A, and 5B, the first feeding hole 111 is formed in the fitting wall 110 in a central area with respect to the right-left direction and in an upper position in the central area. Each first collecting hole 112 is formed in the vicinity of either a left or a right side end of the fitting wall 110 and in a lower position.

Figure 3:
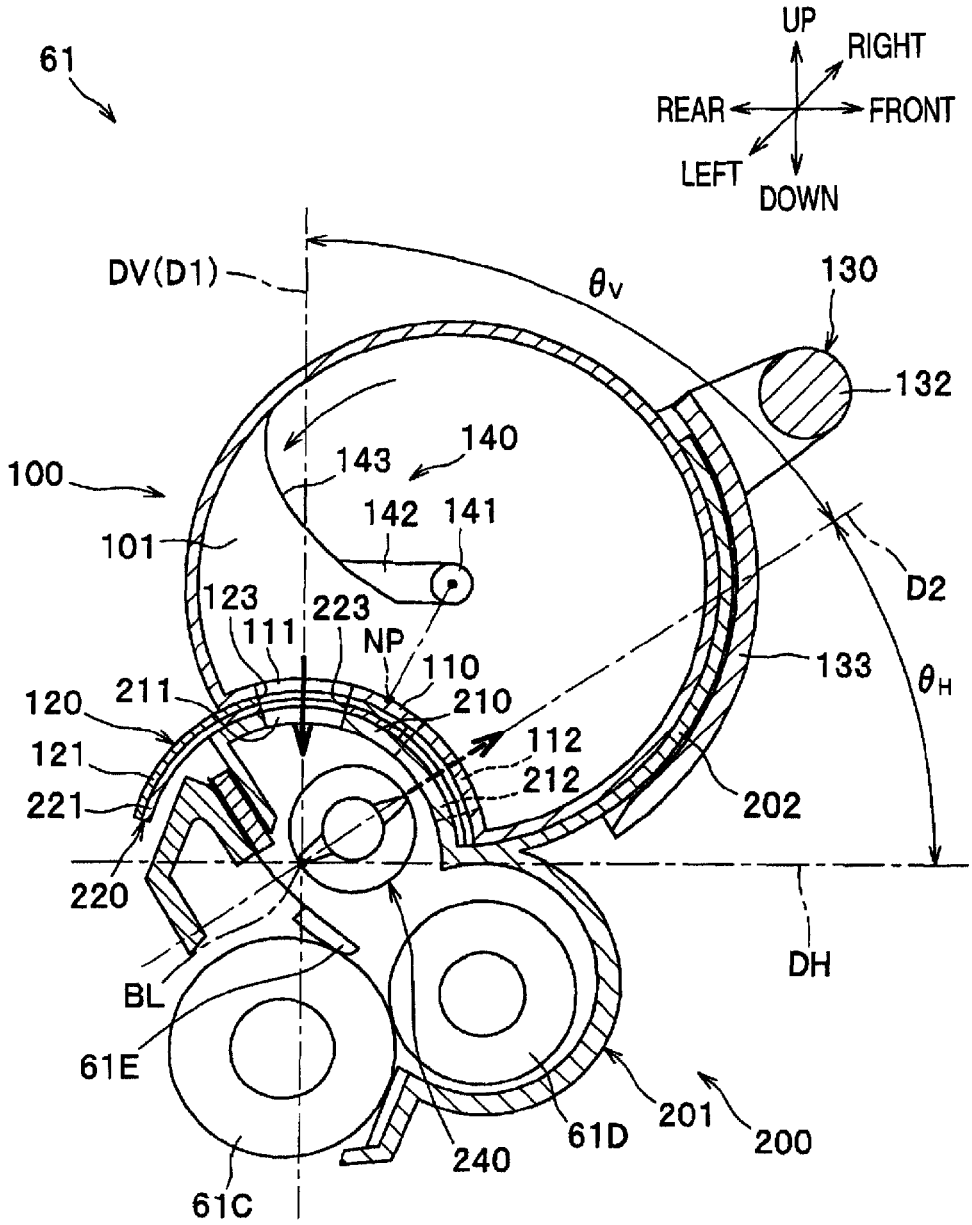
FIG. 3 is a cross-sectional side view of the developer unit according to the embodiment of the present invention.

Further, as shown in the cross-sectional view shown in FIG. 3, the first feeding hole 111 is formed in the fitting wall 110 in an upper-stream position in a rotating direction of the agitator 140 with respect to a nearest point NP, which is in a shortest distance from the rotation axis 141 of the agitator 140. Meanwhile, the first collecting holes 112 are formed in lower-stream positions in the rotating direction of the agitator 140 with respect to the nearest point NP.

According to the present embodiment, an angle $\theta_V$ between a direction D2, along which the first collecting holes 112 are oriented, and a vertical (up-down) direction DV, is larger than an angle between a direction D1, along which the first feeding hole 111 is oriented, and the vertical direction DV. In the present embodiment, the direction D1 coincides with the vertical direction DV, and the angle between the direction D1 and the vertical direction DV is zero degree. Further, an angle $\theta_H$ between the direction D2 and a horizontal (right-left or front-rear) direction DH is smaller than the angle $\theta_V$.

The toner box 100 includes a first shutter 120 (see FIGS. 4, 5A, and 5B), which is slidable along the curvature of the fitting wall 110, to cover and expose the first feeding hole 111 and the first collecting holes 112. The first shutter 120 includes a metal plate 121, which is formed to curve along the fitting wall 110, and a pair of slider pieces 122, which are attached to right and left side edges of the metal plate 121.

In the metal plate 121, an opening 123 is formed in a central area with respect to the right-left direction and in a lower position in the central area. When the first shutter 120 is in a closing position (see FIG. 5A), the first feeding hole 111 and the first collecting holes 112 are covered with the metal plate 121. When the first shutter 120 is shifted in an opening position (see FIG. 5B), the first collecting holes 112 are uncovered, and the opening 123 coincides with the first feeding hole 111. Accordingly, the first collecting holes 112 and the first feeding hole 111 are exposed.

The slider pieces 122, respectively arranged on the right and left side edges of the metal plate 121, are supported by right and left side ends of the fitting wall 110 and slidable with respect to and along the curvature of the fitting wall 110. Each slider piece 122 is formed to have a plurality of dents 124, which can be interlocked with a plurality of teeth 134 in a handler 130, on its outer circumferential edge. Further, the slider piece 122 is formed to have a plurality of teeth 125 on its inner circumferential edge (see also FIG. 7). Thus, the teeth 125 are movable integrally with the teeth 134.

The toner box 100 further includes a shutter handler 130, which can manipulate the first shutter 120 and a second shutter 220. The shutter handler 130 includes a pair of supporting parts 131, a handle 132, and a locking part 133. The supporting parts 131 are attached to the side walls 101 by a rotation shaft 130A and rotatable about the rotation shaft 130A. The handle 132 is a bar extending in parallel with the rotation shaft 130A and connects the left and right supporting parts 131. The locking part 133 is formed to be in, in cross-section, an arc.

Figure 10:
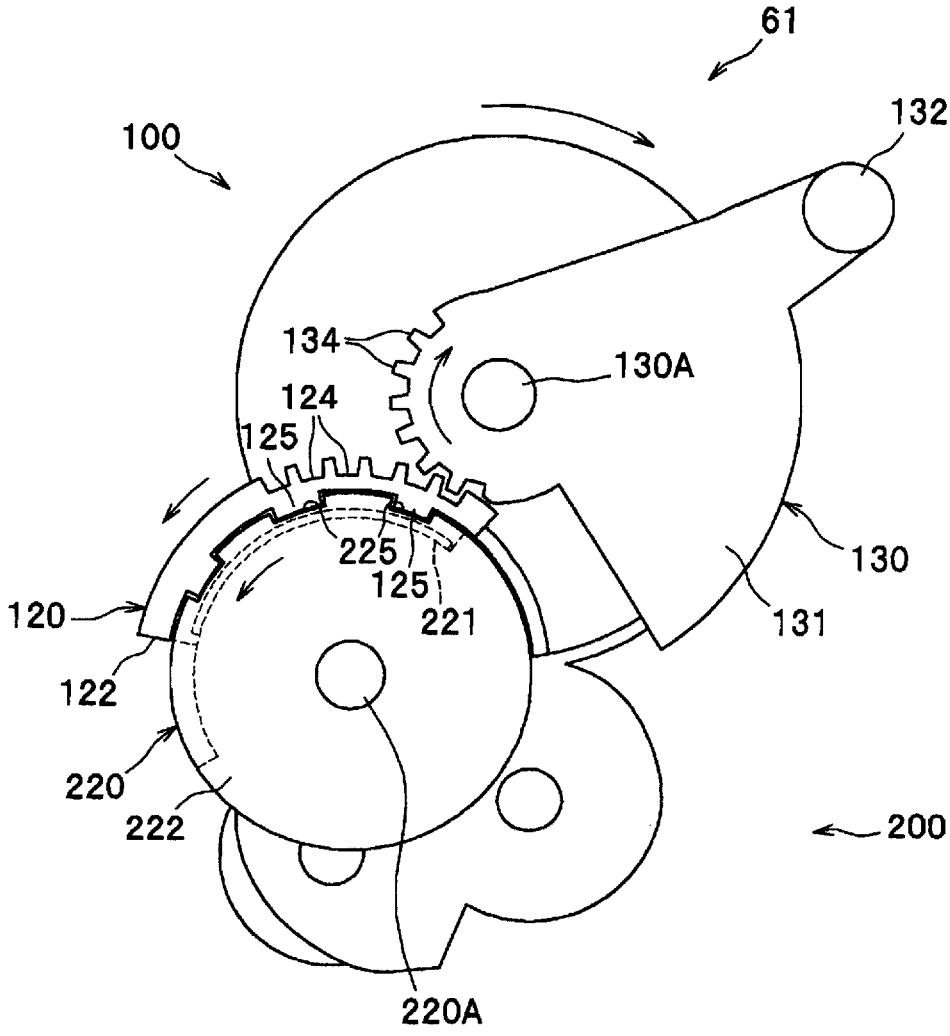
FIG. 10 illustrates opening movement of the first shutter in the toner box of the developer unit according to the embodiment of the present invention.

The shutter handler 130 is further formed to have a plurality of teeth 134 on a side across the rotation shaft 130A from the handle 132. The teeth 134 can be interlocked with the dents 124 in the first shutter 120 so that the first shutter 120 is shifted along the circumference of the fitting wall 110 in cooperation with rotating movement of the supporting parts 131, which are rotated according to a user's manipulation to the handle 132 (see also FIG. 10).

When the toner box 100 is installed in the developer unit 61 and attached to the developer device 200, and when the handle 132 is moved downwardly by the user, the first shutter 120 is moved via the teeth 134 and the dents 124 to the opening position, and the locking part 133 is shifted downwardly. Accordingly, the locking part 133 is shifted to a position, in which a deformable insertion part 202 of the developer device 200 fits between an outer peripheral surface of the toner box 100 and the locking part 133 (see FIG. 3). In the fitting position, the insertion part 202 is caught by the locking part 133 and restricted from being deformed in the front-rear direction. Thus, the toner box 100 and the developer device 200 are interlocked with each other, and the toner box 100 with the first shutter 120 being in the opening position is prevented from being detached from the developer device 200. Accordingly, leakage of the toner from the toner box 100 is prevented.

Inside the toner box 100, the agitator 140 to stir the toner in the toner box 100 is provided. The agitator 140 has the rotation axis 141, a support 142, and a plurality of wings 143 (see also FIG. 6). The rotation axis 141 is rotatably supported by the left and right side walls 101. The support 142 extends from the rotation axis 141 radially, and the wings 143 being flexible sheets are fixed to the support 142.

The agitator 140 is rotated by driving force from a motor (not shown) transmitted to the rotation axis 141. In the present embodiment, the agitator 140 is rotated in a counter clockwise direction as indicated by an arrow inside the toner box 100 in FIG. 3. As the agitator 140 rotates, free ends of the wings 143 sweep inner surfaces of the toner box 100, including an inner surface of the fitting wall 110, and the toner in the toner box 100 is stirred.

Figure 6:
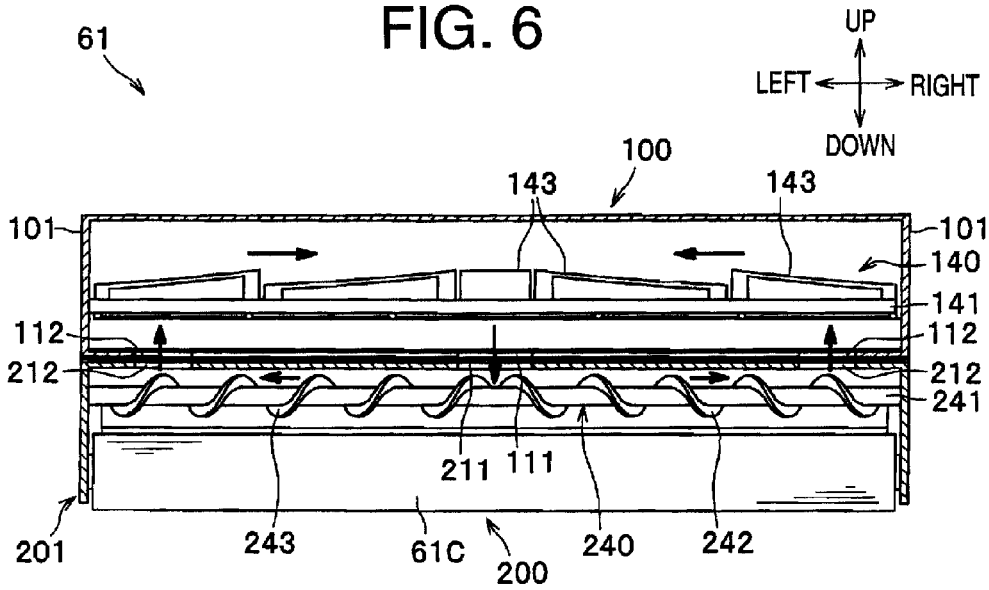
FIG. 6 illustrates a flow of a toner circulated in the developer unit according to the embodiment of the present invention.

A shape and a number of the wings 143 are arbitrarily decided in consideration of efficiency to move the toner in the toner box 100 from the right and left end areas, in which the first collecting holes 112 are formed, toward the central area, in which the first feeding hole 111 is formed (see also FIG. 6). A configuration of such an agitator is known; therefore detailed explanation of that is herein omitted.

Next, the developer device 200 will be described. The developer device 200 includes a developer case 201 being a frame, the developer roller 61C, the supplier roller 61D, and the spreader blade 61E inside the developer case 201. The developer device 200 further includes an auger 240.

The developer case 201 includes a half-pipe wall 210, which is curved outward in an arc in cross-section to fit with the fitting wall 110 of the toner box 100 when the toner box 100 is installed in the developer unit 61. The half-pipe wall 210 is formed to have a second feeding hole 211 and second collecting holes 212. The second feeding hole 211 is formed in a position to coincide with the first feeding hole 111 of the toner box 100, and the second collecting holes 212 are formed in positions to respectively coincide with the first collecting holes 112 of the toner box 100, when the toner box 100 is attached to the developer device 200. Further, a direction, in which the second feeding hole 211 is oriented, corresponds to the orientation of the first feeding hole 111 (i.e., the vertical direction DV), and a direction, in which the second collecting holes 212 are oriented, corresponds to the orientation of the first collecting holes 112 (i.e., the direction D2). In other words, the first feeding hole 111 and the second feeding hole 211 are oriented in the same direction DV to be in communication with each other whilst the first collecting holes 112 and the second collecting holes 212 are oriented in the same direction D2 to be in communication with each other.

Due to the communication between the first feeding hole 111 and the second feeding hole 211 along the vertical direction DV, the toner stored in the toner box 100 is allowed to drop downward in the developer device 200 by use of gravity. Meanwhile, the first collecting holes 112 and the second collecting holes 212 are oriented in the direction D2, which makes a smaller angle between the horizontal line DH than an angle between the vertical direction DV and the direction D2 (i.e., $\theta_H<\theta_V$). Accordingly, the toner in the developer device 200 is allowed to move in the rear-front direction (i.e., nearly in the horizontal direction DH) to the toner box 100.

The developer case 201 further includes the insertion part 202, which extends upwardly in an arc from a front-end portion of the half-pipe wall 210. The insertion part 202 is deformable in the front-rear direction to be caught between the outer surface of the toner box 100 and the locking part 133. With the insertion part 202 being caught between the outer surface of the toner box 100 and the locking part 133, the toner box 100 is detachably attached to the developer device 200 (see also FIGS. 7 and 8). When the toner box 100 is attached to the developer device 200, the deformable insertion part 202 tends to resiliently recover to its original shape, and the resiliency holds the toner box 100 attached stably to the developer device 200.

The developer device 200 has the second shutter 220, which is movable along the curvature of an outer peripheral surface of the half-pipe wall 210 to cover and expose the second feeding hole 211 and the second collecting holes 212. The second shutter 220 includes a metal plate 221, which is formed to curve along the half-pipe wall 210, and a pair of rotary discs 222 (see FIG. 7), which are fixed to right and left side edges of the metal plate 221.

The metal plate 221 is arranged in a position to vertically overlap the metal plate 121 of the first shutter 120 when the toner box 100 is attached to the developer device 200. In the metal plate 221, an opening 223 is formed in a position to correspond to the opening 123 of the first shutter 120.

When the second shutter 220 is in a closing position (see FIG. 9), the second feeding hole 211 and the second collecting holes 212 are covered with the metal plate 221. When the second shutter 220 is moved along the outer periphery of the half-pipe wall 210 to an opening position (see FIG. 3), the second collecting holes 212 are uncovered, and the opening 223 coincides with the second feeding hole 211. In this regard, when the first shutter 120 is also in the opening position, the second collecting holes 212 become in communication with the first collecting holes 112, and the second feeding hole 211 becomes in communication with the first feeding hole 111 through the opening 223 and the opening 123.

Figure 7:
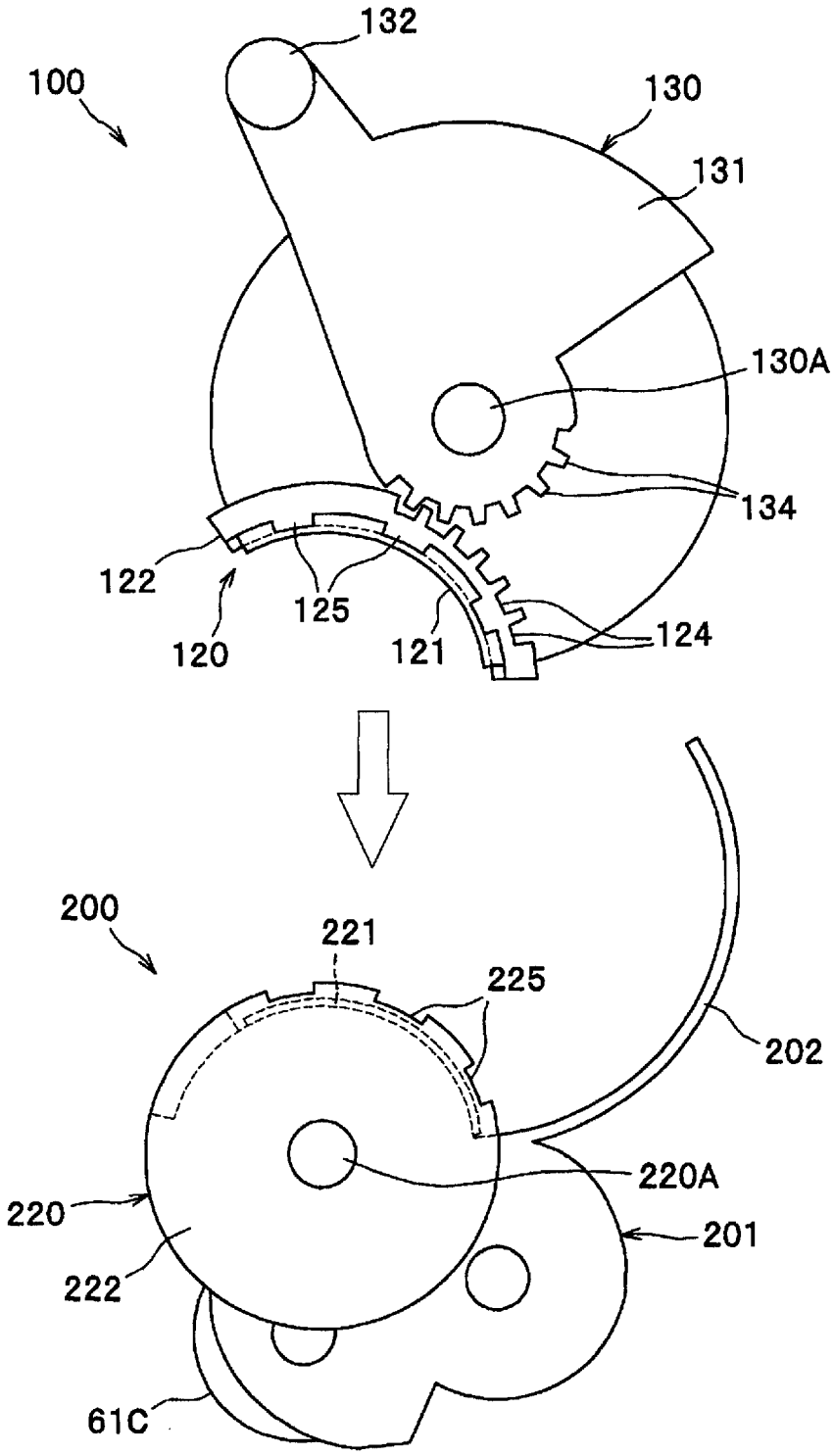
FIG. 7 illustrates an attaching mechanism of the toner box to be installed in the developer unit according to the embodiment of the present invention.
Figure 8:
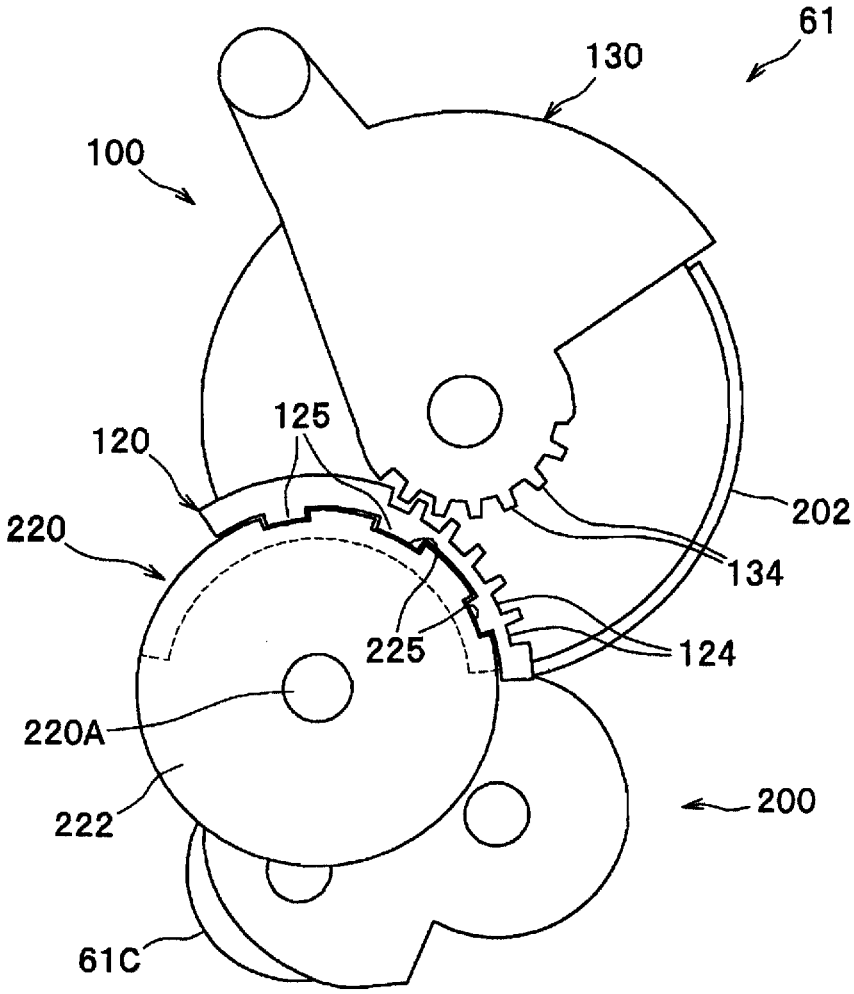
FIG. 8 illustrates the attachment of the toner box in the developer unit according to the embodiment of the present invention.

The rotary discs 222, as one of which is shown in FIG. 7, are arranged on the right and left sides of the developer case 201. The rotary discs 222 are supported by the developer case 201 to be rotatable about a rotation shaft 220A, which coincides with the reference line BL being an axis of the arc of the half-pipe wall 210. The rotary disc 222 is formed to have dents 225, which are interlocked with the teeth 125 of the first shutter 120 when the toner box 100 is attached to the developer device 200 (see FIG. 8).

The auger 240 is a roller with a shaft 241 and spirals 242, 243 to convey the toner fed through the first feeding hole 111 (and the second feeding hole 211) toward the first collecting holes 112 (and the second collecting holes 212). The shaft 241 is rotatably supported by right and left side walls of the developer case 201, and the spirals 242, 243 twine around the shaft 241.

The spirals 242, 243 are respectively arranged on a right side and a left side of the shaft 241, which are divided at a lengthwise center of the shaft 241. The spirals 242, 243 twine in different directions from each other. Accordingly, the toner in the right side area in the developer device 200 is conveyed leftward by the spiral 242, and the toner in the left side area is conveyed rightward by the spiral 243.

Next, attachment of the toner box 100 to the developer device 200 in the developer unit 61 and an opening behavior of the first shutter 120 and the second shutter 220 will be described.

When the toner box 100 is attached to one of the developer devices 200, firstly, the front cover 11 is moved to the open position (see FIG. 2), and the handle 62H is pulled frontward to remove the holder case 62 out of the chassis 10 and expose the developer device 200.

Secondly, the toner box 100 is installed in the developer unit 61 to be attached to the developer device 200. In this regard, the teeth 125 provided to the first shutter 120 in the toner box 100 are interlocked with the dents 225 provided to the second shutter 220 in the developer device 200 (see FIG. 7).

Figure 9:
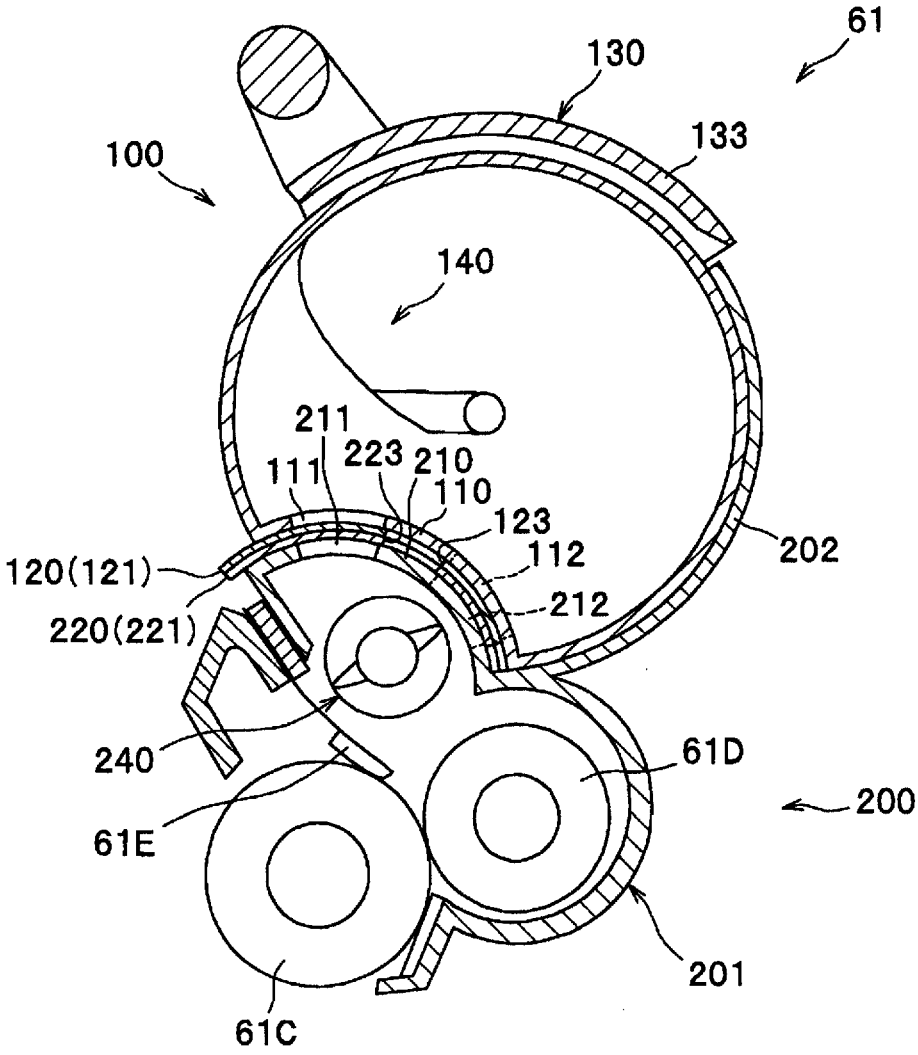
FIG. 9 is a cross-sectional side view of the toner box attached in the developer unit as shown in FIG. 8 according to the embodiment of the present invention.

When the teeth 125 are interlocked with the dents 225 (see FIG. 8), and the toner box 100 is attached to the developer device 200, the metal plate 121 of the first shutter 120 overlaps the metal plate 221 of the second shutter 220 (see FIG. 9). Further, the opening 123 in the metal plate 121 coincides with the opening 223 in the metal plate 221.

In this regard, the first feeding hole 111 and the first collecting holes 112 in the fitting wall 110 are covered with the metal plate 121 of the first shutter 120 in the closing position, and the second feeding hole 211 and the second collecting holes 212 are covered with the metal plate 221 of the second shutter 220 in the closing position. That is, the first and second feeding holes 111, 211 and the first and second collecting holes 112, 212 are closed.

When the first shutter 120 and the second shutter 220 are in the closing positions, the locking part 133 of the shutter handler 130 is in an upper position over the toner box 100, and the insertion part 202 of the developer device 200 is not caught between the outer periphery of toner box 100 and the locking part 133 and deformable. With the insertion part 202 being free from the locking part 133, the toner box 100 can be removed from the developer device 200 if the user moves the toner box 100 upwardly.

Thirdly, when the handle 132 of the shutter handler 130 is rotated in a clockwise direction (see FIG. 10), the first shutter 120 and the second shutter 220 are shifted to the opening positions. Accordingly, the teeth 134 formed in the supporting parts 131 are rotated about the rotation shaft 130A in the clockwise direction.

The rotated teeth 134 move the interlocked dents 124 in the slider piece 122 of the first shutter 120 leftward (in FIG. 10); therefore, the first shutter 120 is rotated in a counterclockwise direction. Further, the teeth 125 in the first shutter 120 move the interlocked dents 225 in the rotary disc 222 leftward (in FIG. 10), and the second shutter 220 is rotated in the counterclockwise direction.

Accordingly, the metal plate 121 of the first shutter 120 is rotated to be shifted in the opening position (see FIG. 3), and the metal plate 221 of the second shutter 220 is rotated in cooperation with the first shutter 120 to be shifted in the opening position. Thus, the first collecting holes 112 and the second collecting holes 212 are uncovered to be communicated with each other, and the first feeding hole 111 and the second feeding hole 211 coincide with each other through the openings 123, 223 to be communicated with each other.

When the first shutter 120 and the second shutter 220 are in the opening positions, the locking part 133 of the shutter handler 130 locks the insertion part 202 in cooperation with the outer periphery of the toner box 100. Accordingly, the toner box 100 is not detachable from the developer device 200. The holder case 62 with the toner box 100 attached to the developer device 200 can be placed back in the chassis 10.

Fourthly, when the toner box 100 needs to be detached from the developer device 200, the holder case 62 is pulled out of the chassis 10, and the handle 132 of the shutter handler 130 is rotated in the counterclockwise direction in FIG. 3. With the counterclockwise rotation of the handle 132, the first shutter 120 and the second shutter 220 are moved in the opposite direction (i.e., the clockwise direction) from the direction of the above-described opening motion. Thus, the first shutter 120 is shifted to the closing position to cover the first feeding hole 111 and the first collecting holes 112, and the second shutter 220 is shifted to the closing position to cover the second feeding hole 211 and the second collecting holes 212 (see FIG. 9). In this regard, the locking part 133 releases the insertion part 202, and the toner box 100 can be detached from the developer device 200.

As has been described, the toner box 100 is equipped with the first shutter 120 to cover and uncover the first feeding hole 111 and the first collecting holes 112 so that leakage of the toner out of the toner box 100 is prevented when the toner box 100 is not attached to the developer device 200. Further, the first feeding hole 111 and the first collecting holes 112 are collectively covered or uncovered by the single opening/closing movement of the first shutter 120.

The developer device 200 is equipped with the second shutter 220 to cover and uncover the second feeding hole 211 and the second collecting holes 212 so that leakage of the toner out of the developer device 200 is prevented when the toner box 100 is not attached to the developer device 200. Further, the second feeding hole 211 and the second collecting holes 212 are collectively covered or uncovered by the single opening/closing movement of the second shutter 220.

In the above embodiment, the first shutter 120 and the second shutter 220 are formed in arcs; therefore, rigidity of the metal plates 121, 221 can be maintained even when the metal plates 121, 221 are formed in thin plates. Further, when the arc-formed shutters 120, 220 are rotated, smaller amounts of twist-deformation can be expected in the arc-formed shutters 120, 220 compared to an amount of deformation which can be caused in slidable plane shutters. In other words, smooth and stable movement of the first shutter 120 and the second shutter 200 can be maintained.

The first shutter 120 has the plurality of dents 124, which are interlocked with the plurality of teeth 134 of the shutter handler 130 so that the first feeding hole 111 and the first collecting holes 112 are covered or uncovered in cooperation with rotation of the shutter handler 130. Thus, the first shutter 120 can be manipulated by the simple movement of the shutter handler 130.

The second shutter 220 has the plurality of dents 225, which are interlocked with the plurality of teeth 125 of the first shutter 120 so that the second feeding hole 211 and the second collecting holes 212 are covered or uncovered in cooperation with the opening/closing movement of the first shutter 120 when the toner box 100 is attached to the developer device 200. Therefore, the first shutter 120 and the second shutter 220 are manipulated in the single opening/closing action.

Next, circulation of the toner within the developer unit 61 will be described. The toner in the toner box 100 is supplied to the developer device 200 through the first feeding hole 111 and the second feeding hole 211, and a part of the toner in the developer device 200 is carried by the developer roller 61C and used in image forming.

Another part of the toner remaining in the developer device 200 is carried leftward and rightward by the auger 240 to be retrieved through the second collecting holes 212 and the first collecting holes 112 in the toner box 100 (see FIG. 6). The retrieved toner in the toner box 100 is stirred by the agitator 140 and collected in the central area of the toner box 100 to be supplied to the developer device 200 again through the first feeding hole 111 and the second feeding hole 211.

In this regard, due to the communication between the first feeding hole 111 and the second feeding hole 211 along the vertical direction DV (see FIG. 3), the toner in the toner box 100 drops down effectively and smoothly in the developer device 200 by use of gravity.

Figures 11A, 11B, 11C:
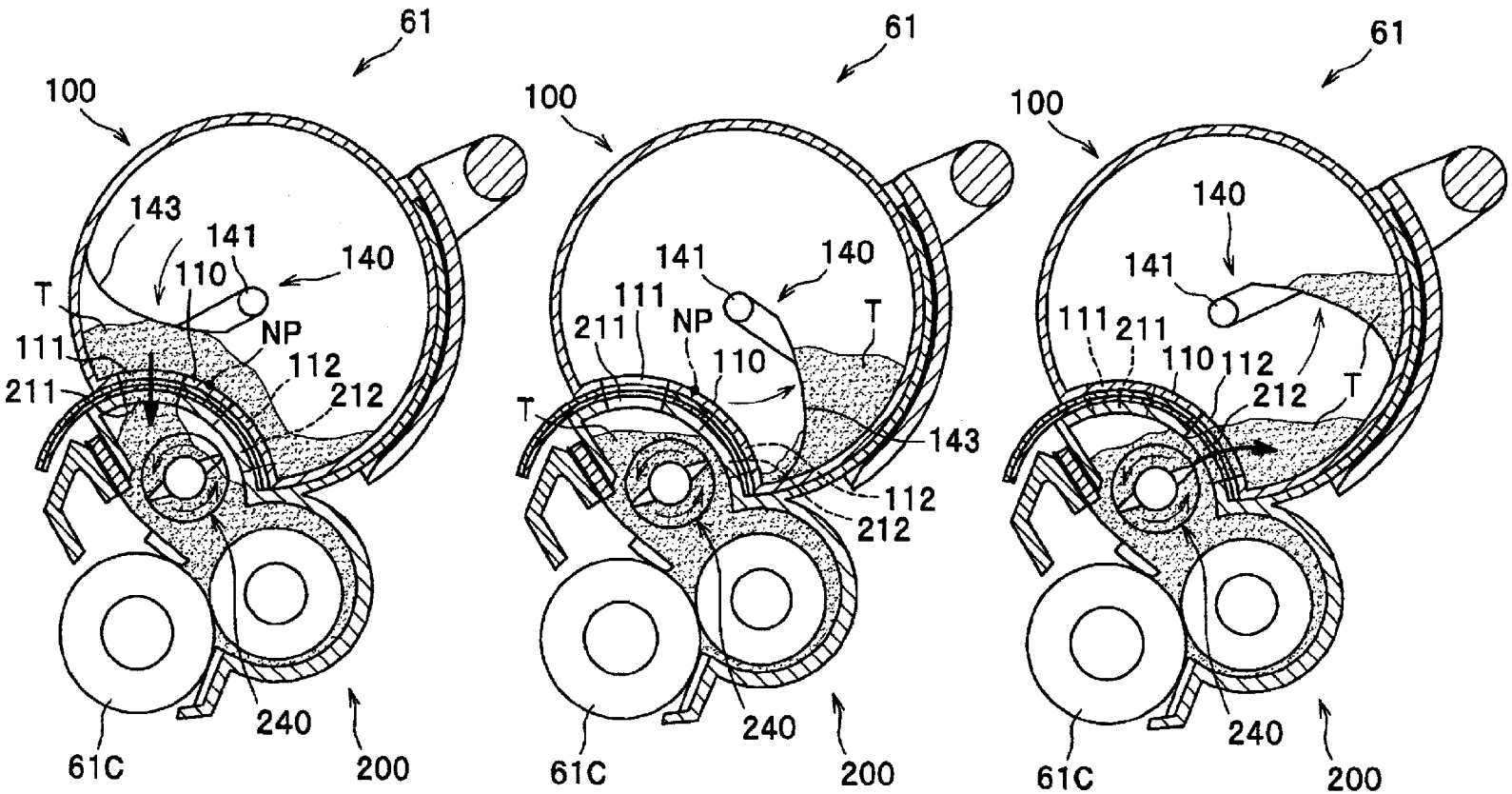
FIGS. 11A-11C illustrate the flow of the toner circulation in the developer unit according to the embodiment of the present invention.

As shown in FIG. 11A, the first feeding hole 111 is formed in the fitting wall 110 in the upper-stream position with respect to the nearest point NP in the rotating direction of the agitator 140. As the wings 143 rotate in the counterclockwise direction in FIG. 11A, the wings 143 moving closer to the first feeding hole 111 press the toner T staying in space between the first feeding hole 111 and the wings 143 downward so that the toner T drops down in the developer device 200. Thus, the toner T is supplied from the toner box 100 to the developer device 200 smoothly.

Further, as shown in FIG. 11B, the first collecting holes 112 are formed in the fitting wall 110 in the lower-stream position with respect to the nearest point NP in the rotating direction of the agitator 140. As the wings 143 rotate in the counterclockwise direction in FIG. 11B, the wings 143 moving further away from the first collecting holes 112 sweep away the toner T staying in areas in vicinities of the first collecting holes 112. Thus, the areas in the vicinities of the first collecting holes 112 are cleared so that following toner T from the developer device 200 can be moved in the cleared areas.

The toner supplied to the developer device 200 is carried leftward and rightward by the auger 240 (see FIG. 6) and accumulate in vicinities of left and right side ends of the auger 240 by pressure of the auger 240. The densely accumulated toner T (see FIG. 11C) is pushed out of the developer device 200 through the second collecting holes 212 by the following toner T, which is carried by the auger 240 to the vicinities of the left and right side ends of the auger 240. Thus, the toner T is retrieved in the toner box 100.

In this regard, due to the communication between the first collecting holes 112 and the second collecting holes 212 nearly along the horizontal direction DH, the toner T in the developer device 200 can be moved smoothly to be retrieved in the toner box 100. When the toner T is pressed through the first collecting holes 112, because the areas in the vicinities of the first collecting holes 112 are cleared by the rotation of the wings 143, the toner T can be smoothly accepted to be retrieved in the toner box 100.

Additionally, the auger 240 (specifically, the shaft 241) may be provided with guiding wings to guide the toner T to the toner box 100 more smoothly in positions opposite from the first and second collecting holes 112, 212.

According to the above configuration of the developer unit 61, in which the toner box 100 is arranged in the upper and adjoining position with respect to the developer device 200, the toner is directed to drop down in the developer device 200 through the first feeding hole 111 by use of gravity.

Further, the angle $\theta_V$ between the direction D2, along which the first collecting holes 112 are oriented, and the vertical direction DV, is larger than the angle (0 degree) between the direction D1, along which the first feeding hole 111 is oriented, and the vertical direction DV. That is, the direction D2 being the orientation of the first collecting holes 112 is set to be nearer to the horizontal line DH. Therefore, the toner in the developer device 200 can be moved in the nearly horizontal direction toward the toner box 100 by utilizing its own behavior and by being accumulated. Thus, the toner can be retrieved efficiently in the toner box 100 in the smoother behavior than toner being required to move upwardly against gravity.

According to the above configuration of the developer unit 61, in which the toner box 100 is arranged in the upper position with respect to the developer device 200, the toner can be circulated smoothly simply when the angle $\theta_V$ between the direction D2, along which the first collecting holes 112 are oriented, and the vertical direction DV, is larger than the angle between the direction D1, along which the first feeding hole 111 is oriented, and the vertical direction DV.

When the first feeding hole 111 and the second feeding hole 211 are communicated with each other along the vertical direction DV, and when the first collecting holes 112 and the second collecting holes 212 are oriented in the direction D2, which makes a smaller angle between the horizontal line DH than an angle between the vertical direction DV and the direction D2 (i.e., $\theta_H<\theta_V$), the toner can be smoothly circulated in the developer unit 61. When the toner is thus efficiently circulated, opening areas of the first and second feeding holes 111, 211 and the first and second collecting holes 112, 212 can be made smaller. Accordingly, rigidity of the developer unit 61 can be improved.

In the developer unit 61, the first feeding hole 111 and the first collecting holes 112 are formed in laterally (in the right-left direction) displaced positions. Meanwhile, the developer device 200 is equipped with the auger 240, which moves the toner supplied through the first and second feeding holes 111, 211 leftward and rightward to be retrieved back in the toner box 100 through the first and second collecting holes 112, 212. Therefore, fluidity of the toner between the toner box 100 and the developer device 200 is improved to be better than fluidity of toner in a toner box 100 and a developer device 200 with the first feeding hole 111 and the first collecting holes 112 being formed in laterally coinciding positions.

Although an example of carrying out the invention has been described, those skilled in the art will appreciate that there are numerous variations and permutations of the developer unit that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, in the above embodiment, the direction D1 of the orientation of the first feeding hole 111 coincides with the vertical direction DV, i.e., the angle between the direction D1 and the vertical direction DV is zero degree. However, the direction D1 may not necessarily coincide with the vertical direction DV, and the angle between the direction D1 and the vertical direction DV may be larger than zero degree.

For another example, the first collecting holes 112 may not necessarily be oriented at the angle $\theta_H$ with respect to the horizontal line DH. For example, the orientation of the first collecting holes 112 may coincide with the horizontal line DH.

In the above embodiment, manipulation of the first shutter 120 and the second shutter 220 is enabled by the engagement of a gear having teeth 134 with a gear having dents 124, and a gear having teeth 125 with a gear having dents 225. However, the engagement may be achieved by different combinations of teeth and dents. That is, a set of teeth and dents may be engaged with a set of dents and teeth, and vice versa. The combinations of the teeth and the dents may be designed to be different amongst the developer units 61 in the MFP 1 in order to have the toner boxes 100 to be attached to correct developer devices 200 respectively. Whilst the MFP 1 operates four toner boxes 100, each of which contains toner in a different color, the toner boxes 100 are required to be attached to the mating developer devices 200 for correct image forming. Therefore, when the combinations of the teeth and the dents are differentiated amongst the developer units 61, the toner boxes 100 are only accepted by the mating developer devices 200 correctly, and mismatch of the toner box 100 and the developer device 200 in the developer unit 61 can be prevented.

For another example, the fitting wall 100 may not necessarily be formed to have a cross-sectional shape of an arc as long as the fitting wall 100 is formed to curve inward. Further, a number, sizes, and shapes of the first feeding holes 111 and the first collecting holes 112 are not limited to those described in the above embodiment.

In the above embodiment, the developer unit 61 with the toner box 100 detachable from the developer device 200 is described. However, a developer unit 61 having a toner container undetachably fixed to the developer device may be provided.

Further, the auger 240 to carry the toner sideward may be replaced with, for example, a coil spring.

Furthermore, the sheet P to have an image formed thereon may be, for example, an OHP sheet.

In the above embodiment, the MFP 1 being an image forming apparatus having the developer unit 61 according to the present invention is described. However, the image forming apparatus may be, for example, a copier and a printer. Furthermore, the number of the developer unit 61 is not limited to four, but may be, for example, one.

What is claimed is:

1. A developer unit for an image forming apparatus to form an image on a recording sheet, comprising:

a developer device having a developer agent carrier, which carries a developer agent on a surface thereof;

a developer agent container, which contains the developer agent and is arranged in an upper position with respect to the developer device in the developer unit;

wherein the developer agent container is formed to have a fitting wall, which is curved inward at a position to be adjacent to the developer device;

wherein the developer agent container includes an agitator, which is rotated to sweep an inner surface of the fitting wall and stir the developer agent in the developer agent container;

wherein the fitting wall is formed to have a first feeding hole, through which the developer agent in the developer agent container is supplied to the developer device, and a first collecting hole, through which the developer agent in the developer device is retrieved; and wherein a first angle between a direction, in which the first collecting hole is oriented, and a vertical direction is larger than a second angle between a direction, in which the first feeding hole is oriented, and the vertical direction.

2. The developer unit according to claim 1, wherein the first feeding hole is oriented in the vertical direction; and wherein a third angle between the direction of the orientation of the first collecting hole and a horizontal direction is smaller than a fourth angle between the direction of the orientation of the first collecting hole and the vertical direction.

3. The developer unit according to claim 2, wherein the fourth angle is equal to the first angle.

4. The developer unit according to claim 1, wherein the first feeding hole and the first collecting hole are in positions displaced from each other with respect to a direction of a rotation axis of the agitator; and wherein the developer device is provided with a conveyer, which conveys the developer agent supplied through the first feeding hole toward a vicinity of the first collecting hole.

5. The developer unit according to claim 1, wherein the first feeding hole is formed in an upper-stream position with respect to a nearest point to a rotation axis of the agitator in a rotating direction of the agitator; and wherein the first collecting hole is formed in a lower-stream position with respect to the nearest point in the rotating direction of the agitator.

6. The developer unit according to claim 1, wherein the developer agent container is detachable from the developer device;

wherein the fitting wall is curved inward in an arc in cross-section to center around a reference line, which extends in parallel with a rotation axis of the agitator; and wherein the developer agent container is provided with a first shutter, which is movable along a curvature of the fitting wall to cover and expose the first feeding hole and the first collecting hole.

7. The developer unit according to claim 6, wherein the developer device has an arched wall, which is curved outward in an arc in cross-section to fit with the fitting wall when the developer agent container is attached to the developer device;

wherein the arched wall is formed to have a second feeding hole, which is in communication with the first feeding hole when the developer agent container is attached to the developer device, and a second collecting hole, which is in communication with the first collecting hole when the developer agent container is attached to the developer device; and wherein the developer device is provided with a second shutter, which is movable along a curvature of the arched wall to cover and expose the second feeding hole and the second collecting hole.

8. The developer unit according to claim 7, wherein the developer agent container has a rotatable handler with a first interlocking part;

wherein the first shutter has a second interlocking part to be engaged with the first interlocking part of the handler; and wherein the first shutter covers and exposes the first feeding hole and the first collecting hole in cooperation with rotating movement of the handler via the engagement of the first interlocking part and the second interlocking part.

9. The developer unit according to claim 8, wherein the first shutter has a third interlocking part, which is movable integrally with the second interlocking part;

wherein the second shutter has a fourth interlocking part, which is engaged with the third interlocking part when the developer agent container is attached to the developer device; and wherein the second shutter covers and exposes the second feeding hole and the second collecting hole in cooperation with the first shutter via the engagement of the third interlocking part and the fourth interlocking part.

* * * * *